United States Patent [19]

Pennewiss et al.

[11] Patent Number: 4,867,894

[45] Date of Patent: Sep. 19, 1989

[54] POUR POINT IMPROVING ADDITIVES FOR MINERAL OILS

[75] Inventors: Horst Pennewiss, Darmstadt; Heinz Jost, Modautal; Helmut Knoell, Lautertal, all of Fed. Rep. of Germany

[73] Assignee: Röhm GmbH, Darmstadt, Fed. Rep. of Germany

[21] Appl. No.: 185,317

[22] Filed: Apr. 20, 1988

Related U.S. Application Data

[63] Continuation of Ser. No. 17,136, Feb. 20, 1987, abandoned.

[30] Foreign Application Priority Data

Mar. 7, 1986 [DE] Fed. Rep. of Germany ..... 3607444

[51] Int. Cl.[4] ..... C10M 145/14

[52] U.S. Cl. ..... 252/56 R; 560/190; 560/196; 252/51.5 R

[58] Field of Search ..... 252/56 R; 560/190, 196

[56] References Cited

U.S. PATENT DOCUMENTS

| | | | |
|---|---|---|---|
| 2,091,627 | 8/1937 | Bruson | 37/9 |
| 2,100,993 | 11/1937 | Bruson | 260/2 |
| 2,114,233 | 4/1938 | Neher et al. | 260/2 |
| 3,218,258 | 11/1965 | Bauer et al. | 252/51.5 |
| 3,226,326 | 12/1965 | Lorensen | 252/56 R |
| 3,238,133 | 3/1966 | Lorensen | 252/56 R |
| 3,397,146 | 8/1968 | Cupper et al. | 252/34 |
| 3,475,321 | 10/1969 | Henselman | 252/56 R |
| 3,598,736 | 8/1971 | Van der Meij | 252/56 R |
| 3,697,644 | 7/1972 | Van der Meij et al. | 252/56 R |
| 3,869,396 | 3/1975 | Van de Kraats et al. | 252/56 R |
| 3,878,180 | 4/1975 | Holder et al. | 260/89.5 A |
| 3,951,929 | 4/1976 | Sweeney | 252/56 R |
| 4,045,376 | 8/1977 | Rubin et al. | 252/56 R |
| 4,123,368 | 10/1978 | Leister et al. | 252/56 R |
| 4,146,492 | 3/1979 | Cusano et al. | 252/56 R |
| 4,153,424 | 5/1979 | Wisotsky | 44/62 |
| 4,229,311 | 10/1980 | Wenzel et al. | 252/56 R |
| 4,496,691 | 1/1985 | Proux et al. | 252/56 R |
| 4,650,596 | 3/1987 | Schlueter et al. | 252/56 R |

FOREIGN PATENT DOCUMENTS

| | | |
|---|---|---|
| 0113591 | 7/1984 | European Pat. Off. . |
| 0140274 | 5/1985 | European Pat. Off. . |
| 1444884 | 1/1969 | Fed. Rep. of Germany . |
| 3339103 | 5/1985 | Fed. Rep. of Germany . |
| 1235693 | 5/1960 | France . |
| 1368159 | 9/1974 | United Kingdom . |

*Primary Examiner*—William R. Dixon, Jr.
*Assistant Examiner*—Ellen M. McAvoy
*Attorney, Agent, or Firm*—Curtis, Morris & Safford

[57] ABSTRACT

Polymers adaptable to use as pour point lowering additives for petroleum oils, said polymers comprising as comonomers therein (a) from 10 to 30 mole percent of methyl methacrylate, (b) from 10 to 70 mole percent of alkyl methacrylates having linear alkyl groups with from 16 to 30 carbon atoms in the alkyl group, (c) from 10 to 80 mole percent of alkyl methacrylates having linear alkyl groups with from 4 to 15 carbon atoms in the alkyl group and/or having branched alkyl groups with from 4 to 40 carbon atoms in the alkyl group, (d) from 0 to 30 mole percent of a free-radically polymerizable nitrogen-containing monomer having dispersing action, and petroleum oils containing such polymers as pour point lowering additives.

11 Claims, No Drawings

POUR POINT IMPROVING ADDITIVES FOR MINERAL OILS

This application is a continuation of application of Ser. No. 0107,136 filed Feb. 20, 1987, now abandoned.

FIELD OF THE INVENTION

The present invention relates to polyalkyl methacrylates useful as additives for lowering the pour point of petroleum oils, and particularly distillate oils.

Distillate oils are well known in the art, for example as discussed in Kirk-Othmer, Encyclopedia of Technical Chemistry, 3rd Edn., Vol. 17, pp. 223 ff., J. Wiley (1982). They are petroleum oil fractions which particularly include a lubricating oil fraction which boils above 370° C. at atmospheric pressure (but which in practice is usually distilled off under vacuum). The prior art Petroleum oils such as the commercial distillate oils usually contain n-paraffin hydrocarbons. While the latter are conducive to obtaining good viscosity-temperature characteristics, they crystallize out on cooling and thus inhibit or completely neutralize the fluidity of the oils. An improvement in the low temperature flow properties can be secured by dewaxing. Since the costs increase substantially when the pour point is to be lowered below certain levels, the oils are generally only partially dewaxed to a pour point of about −15° C. and further lowering of the pour point (to about −40° C.) is then achieved by the use of so-called pour point depressants, which will effectively lower the pour point even at concentrations from 0.05 to 1 percent.

This is more or less consistent with the hypothesis that paraffin-like compounds are incorporated into the growing paraffin crystal surfaces and so prevent the further growth of the crystals and the formation of extensive interlocking networks of crystals.

With regard to the mode of action of such pour point depressants, it is thought that they have certain structural elements, namely alkyl groups sufficiently long to be incorporated into the growing paraffin crystals right from nucleation and, at fairly large intervals, side chains or side groups to inhibit crystal growth. (See Ullmanns Enzyklopaedie der technischen Chemie, 4th Ed., Vol. 20, p. 548, Verlag Chemie, 1981). To be suitable for commercial use, pour point depressants must also possess good thermal, oxidative, and chemical stability, shear strength, etc.

The currently preferred pour point depressants are polymethacrylates which will sufficiently lower the pour point of lubricating oils even in concentrations of 0.1 to 0.5 percent. (See U.S. Pat. Nos. 2,091,627; 2,100,993; and 2,114,233). The number of carbon atoms in the alkyl groups is from 12 to 18 and the degree of branching is from 10 to 30 mole percent. Polymethacrylates are available whose average molecular weight ranges from about 5,000 to 500,000 and which permit improvement of the flow properties of light, low molecular weight to heavy, high molecular weight lubricating oils.

Olefin copolymers (OCP's) are also considered effective additives for petroleum oils from the viewpoint of many application criteria. (See published German Patent Application DAS No. 1,235,491).

Copolymers from these two polymer classes have therefore attracted considerable attention. For example, published German Patent Application DOS No. 21 02 469 among other things describes low molecular weight copolymers of ethylene with methyl methacrylate or with 2-ethylhexyl acrylate having average molecular weights between 720 and 1,400. These are obtained by high-pressure polymerization in the presence of chain transfer agents and act as pour point depressants.

European Patent Application No. 113,591 describes hydrogenated emulsion copolymers of 1,3-butadiene with alkyl acrylates or alkyl methacrylates as lubricating oil and fuel additives which can be used as VI improvers and pour point depressants. Dispersing action can be imparted to these polymers by grafting them with polar monomers containing nitrogen.

Published German Patent Application DOS No. 2,612,232 suggests the use of a combination of an ethylene-isobutyl acrylate copolymer and a copolymer of methyl methacrylate with polytetradecyl acrylate or hexadecyl methacrylate as an additive for petroleum distillates (boiling point, 120°–480° C.) for regulation of wax crystal formation in the low temperature region.

The reaction products of a long chain alkyl acrylate or methacrylate, a $C_1$–$C_4$ alkyl acrylate or methacrylate, and acrylic acid that has been neutralized with a 1-hydroxy-2-alkyl-imidazoline or a 1-hydroxy-2-alkylideneimidazoline are suggested in U.S. Pat. No. 3,397,146 for use as viscosity-index improvers having dispersing action. Published German Patent Application DOS No. 2,145,249 suggests polymethyl methacrylates produced with amines as initiators for use as lubricating oil additives. An example describes the production of polybutyl methacrylate with a molecular weight of 455,000.

Additives comprising mixtures of different acrylate polymers have further been developed for lubricating oils containing n-paraffin. (Published German Patent, Application DOS No. 3,339,103). These mixtures consist of a solvent and:

(I) from 10 to 99 weight percent of polymers $P^1$ composed of:

(a) acrylic acid esters or methacrylic acid esters of linear $C_6$–$C_{15}$ alcohols, (b) acrylic acid esters or methacrylic acid esters of linear $C_{16}$–$C_{30}$ alcohols, (c) acrylic acid esters or methacrylic acid esters of branched $C_8$–$C_{40}$ alcohols, (d) acrylic acid esters or methacrylic acid esters of $C_1$–$C_5$ alcohols, and (e) other, different, monomers having functional groups, the amount of (b) being not more than 5 mole percent, and (II) from 1 to 90 weight percent of polymers P2 composed of:

(a') acrylic acid esters or methacrylic acid esters of linear $C_6$–$C_{15}$ alcohols, (b') acrylic acid esters or methacrylic acid esters of linear $C_{16}$–$C_{30}$ alcohols, (c') acrylic acid esters or methacrylic acid esters of branched $C_8$–$C_{40}$ alcohols, (d') acrylic acid esters or methacrylic acid esters of $C_1$–$C_5$ alcohols, and (e') other, different, monomers having functional groups, the amount of (b') being from 10 to 70 mole percent.

Pour point depressants containing methyl methacrylate have so far not gained commercial acceptance. One reason for this may have been the justifiable expectation that products which contain substantial amounts of methyl methacrylate will develop satisfactory activity only when added in large quantities.

THE OBJECT OF THE INVENTION

The need persists to provide pour point depressants for petroleum oils comprising paraffin, particularly distillate oils, at lower cost, yet which have undiminished effectiveness, that is which are effective in about the same concentrations as materials now in use. A particular desideratum has been to find a substitute for the relatively expensive higher alkyl esters.

It has now been found that the pour point lowering additives of the invention will admirably fill this need.

The inventive additives with pour point lowering action consist of a polymer composed of:

(a) from 10 to 30, and preferably from 10 to 20, mole percent of methyl methacrylate;

(b) from 10 to 70, and preferably from 10 to 50, mole percent of alkyl methacrylates comprising linear alkyl groups having from 16 to 30 carbon atoms;

(c) from 10 to 80, and more particularly from 50 to 80, and preferably from 30 to 80, mole percent of alkyl methacrylates comprising linear alkyl groups having from 4 to 15, and preferably from 6 to 15, carbon atoms and/or branched alkyl groups having from 4 to 40, and preferably from 8 to 30, carbon atoms; and optionally (d) from 0 to 30, and preferably from 0.5 to 20, mole percent of a nitrogen-containing monomer having dispersing action, preferably one of the formula:

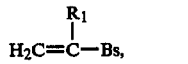

(I)

wherein $R_1$ is hydrogen or methyl and $B_s$ is an inert heterocyclic five- or six-membered ring or

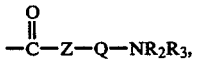

wherein Z is oxygen or $NR_4$, Q is a linear or branched aliphatic hydrocarbon bridge having a total of from 2 to 10 carbon atoms, and $R_2$ and $R_3$ alone each are alkyl having from 1 to 6 carbon atoms or together with the nitrogen atom and optional further nitrogen or other hetero atoms form a heterocyclic five- or six-membered ring, and wherein $R_4$ is hydrogen or alkyl having from 1 to 6 carbon atoms.

By "other hetero atoms" are meant, in particular, oxygen or sulfur.

The five- or six-membered heterocyclic systems may also contain a carbonyl group, that is, may belong to the family of the lactams.

Preferred monomers (d) are defined when Q is $—CH_2CH_2—$ or $—CH_2—C(CH_2-CH_2—$ and when $R_2$ and $R_3$ are both methyl.

The polymers preferably have molecular weights ranging from 10,000 to 800,000. The molecular weight may be determined conventionally by gel permeation chromatography. [See Vieweg-Braun, Kunstoff-Handbuch ("Plastics Manual"), Vol. I, Carl Hanser Verlag, 1975]. The non-uniformities (Mw/Mn) of the polymers usually range from 1.5 to 5.0.

The Staudinger Index ranges from 10 to 150 ml/g in chloroform at 20° C.

A preferred embodiment of the invention requires that when the amount of linear alkyl methacrylates (c) having from 4 to 15 carbon atoms in the alkyl group is from 35 to 45 mole percent of the polymer, then the amount of component (b) of the polymer is between 20 and 30 mole percent. A requirement of a further preferred embodiment of the invention is that when the amount of linear alkyl methacrylates (c) having from 4 to 15 carbon atoms in the alkyl group is from 15 to 30 mole percent, then the amount of component (b) of the polymer is between 25 and 40 mole percent. Still another preferred embodiment of the invention requires that when the amount of linear alkyl methacrylates (c) having from 4 to 15 carbon atoms in the alkyl group is zero mole percent, then the amount of component (b) of the polymer is between 30 and 50 mole percent.

The monomers for the components (a) to (d) of the polymer are known per se.

Monomers suitable for use as component (b) are the methacrylic acid esters of linear $C_{16}$–$C_{30}$ alkanols and particularly of linear $C_{16}$–$C_{24}$ alkanols, and more particularly of linear $C_{18}$–$C_{22}$ alkanols. Illustrative of these are, in particular, commercial products such as the tallow alcohols and "Alfols". Thus the type (b) monomers may include different esters. Such mixtures may be regarded as advantageous.

Suitable monomers for component (c) are the methacrylic acid esters of linear $C_4$–$C_{15}$ alkanols. Examples are the linear $C_{10}$–$C_{14}$ alcohols, and especially those obtained by the Ziegler process by the hydrolysis of aluminum alkoxides. Commercial products of this type are sold under the marks "Lorol" and "Alfol", for example. However, the monomers of component (c) may also be methacrylic acid esters of branched alkanols having from 4 to 40 carbon atoms in the molecule, and particularly of branched $C_8$–$C_{20}$ alcohols of the isoalkanol type, and especially of isodecyl, isotridecyl, and isooctodecyl alcohol.

Component (d) of the polymer is made up of nitrogenous monomers having functional groups in the molecule and polymerizable by the use of free-radical initiators, especially those monomers which are known to additives.

Illustrative of these are C- and N-vinylpyridine, vinylpyrrolidone, vinylcarbazole, and vinylimidazole, as well as their alkyl derivatives, and particularly the N-vinyl compounds; the dialkylaminoalkyl esters of acrylic acid or methacrylic acid, and particularly dimethylaminoethyl acrylate and methacrylate and dimethylaminopropyl acrylate and methacrylate; as well as the corresponding dialkylaminoalkyl acrylamides and methacrylamides, for example dimethylaminopropyl acrylamide or methacrylamide.

The average molecular weights of the polymers most preferably range from 50,000 to 500,000.

The polymers may be produced by the usual free-radical polymerization processes. [See H. Rauch-Puntigam and Th. Voelker: Acryl- und Methacrylverbindungen ("Acrylic and Methacrylic Compounds"), Springer-Verlag, Berlin, 1967].

PRODUCTION OF POLYMERS

The production of the polymers is consistent with prior art polymerization processes. A mixture of a petroleum oil and a monomer mixture of (a), (b), (c), and (d) is charged to a reaction vessel which is advantageously equipped with a stirrer, thermometer, reflux condenser, and metering line. The charge is heated under a $CO_2$ blanket and with stirring to about 90°–100° C. After this temperature is reached and an initiator (preferably a peroxy compound such as a perester or peroxide, or an azo compound) is added, a mixture of the monomers (a), (b), (c), and (d) and more initiator is metered in. About 2 hours after the completion of this addition, still more initiator is fed in. The total amount of initiator usually ranges from 1 to 3 weight percent, based on the total amount of monomers. The total polymerizaon time generally is between 8 and 9 hours. A viscous solution is obtained having a polymer content which usually ranges from 40 to 70 weight percent.

OIL BLEND FOR THE MEASUREMENT OF POUR POINT, LOW TEMPERATURE, VISCOSITY, AND STABLE POUR POINT

The additive in accordance with the invention is dissolved in the base oil with stirring at 50°-60° C., optionally together with further additive materials such as a detergent-inhibitor package and OCP viscosity-index improvers.

USE OF ADDITIVES

The additives of the invention can be conventionally added to petroleum oils. For use as pour point depressants, the addition should be from 0.1 to 1.0 weight percent. The available petroleum oils have been discussed earlier herein. General information will be found in Ullmanns, loc. cit., pp. 457-503.

Among the advantages offered by the invention are improved activity in certain petroleum oils and a broader spectrum of activity in petroleum oils of differing viscosities.

Oil formulations containing the additives of the invention exhibit very good values for pour point and stable pour point and excellent viscosity data over the −15° C. to −40° C. range, in addition to the required viscosity data at 100° C.

They can be characterized according to the following measurements or properties:

| | |
|---|---|
| Pour point/Cloud point | DIN 51497 |
| Pour stability (stable pour point) | Fed. Test. Meth. 203 Std. No. 791/Cycle C |
| Mini Rotary Viscosimeter viscosity | ASTM D 3829 |
| Cold Cranking Simulator viscosity | DIN 51377 |
| Brookfield viscosity | DIN 51398 |

A better understanding of the present invention and of its many advantages will be had from the following Examples, given by way of illustration:

EXAMPLE 1

Additive A

To prepare an additive, the following mixture is charged to a 2-liter four-necked flask equipped with stirrer, thermometer, reflux condenser, and metering line:

300 g of petroleum oil, $\eta_{100° C.}$=3.9 mm²/sec),
21.00 g of the methacrylic acid ester of a $C_{12}$-$C_{15}$ alcohol mixture comprising 23 percent of branched alcohols,
8.97 g of the methacrylic acid ester of a linear $C_{16}$-$C_{18}$ alcohol mixture,
3.33 g of methyl methacrylate,
0.13 g of dodecyl mercaptan, and
0.36 g of tert.-butyl peroctoate.

After the components have been dissolved, the following mixture is metered in over a period of 210 minutes at 100° C.:

420.6 g of the methacrylic acid ester of a $C_{12}$-$C_{15}$ alcohol mixture comprising 23 percent of branched alcohols,
179.41 g of the methacrylic acid ester of a linear $C_{16}$-$C_{18}$ alcohol mixture,
66.67 g of methyl methacrylate,
2.67 g of dodecyl mercaptan, and
2.0 g of tert.-butyl peroctoate.

Two hours after completion of this addition, 1.4 g of tert.-butyl peroctoate are fed in.

Total polymerization time: 8 hours. A clear, viscous solution is obtained.

Polymer content 70 weight percent.

Viscosity (100° C., 70 weight percent): 800 mm²/sec

Composition:

24 mole percent (a)
20 mole percent (b)
56 mole percent (c), of which
43 mole percent are classed as linear $C_4$-$C_{15}$ alkyl methacrylates.

COMPARATIVE EXAMPLE 1

Additive B

Prepared in the same manner as Additive A, with the following exceptions:

Initial charge:

300 g of petroleum oil 72 $_{100° C.}$=3.9 mm²/sec),
25.8 g of the methacrylic acid ester of a $C_{12}$-$C_{15}$ alcohol mixture comprising 23 percent of branched alcohols,
7.5 g of the methacrylic acid ester of a linear $C_{16}$-$C_{18}$ alcohol mixture,
0.13 g of dodecyl mercaptan, and
0.36 g of tert.-butyl percotoate.

Addition:

517.4 g of the methacrylic acid ester of a $C_{12}$-$C_{15}$ alcohol mixture comprising 23 percent of branched alcohols,
149.3 g of the methacrylic acid ester of a linear $C_{16}$-$C_{18}$ alcohol mixture,
2.67 g of dodecyl mercaptan, and
2.0 g of tert.-butyl peroctoate.

Polymer content: 70 percent

Viscosity (100° C., 70 weight percent); 560 mm2/sec

Composition:

0 mole percent (a)
20 mole percent (b)
79 mole percent (c), of which
62 mole percent are to be classed as linear $C_4$-$C_{15}$ alkyl methacrylates.

TABLE 1

Low-temperature viscosity (−40° C.) in mPa.s in conformity with DIN 51398 in NS 100 petroleum oil (viscosity, 3.8 mm²/sec at 100° C.)

| | | Amount of additive added weight percent | | |
|---|---|---|---|---|
| | Additive | 0.5 | 1.0 | 1.5 |
| Example 1 | A | 62,000 | 70,000 | 152,000 |
| Comparative Example 1 | B | 223,000 | 180,000 | 280,000 |

EXAMPLE 2

Additive C

Prepared in the same manner as Additive A, with the following exceptions:

Initial charge:

360 g of petroleum oil ($\eta_{100°\,C.}$=3.9 mm$^2$/sec), 18.56 g of the methacrylic acid ester of a linear $C_{16}$–$C_{18}$ alcohol mixture, 4.0 g of the methacrylic acid ester of a linear $C_{12}$–$C_{14}$ alcohol mixture, 15.2 g of the methacrylic acid ester of a $C_{12}$–$C_{15}$ alcohol mixture comprising 60 percent of branched alcohols, 2.24 g of methyl methacrylate, and 1.4 g of tert.-butyl peroctoate.

Addition:

371.2 g of the methacrylic acid ester of a linear $C_{16}$–$C_{18}$ alcohol mixture, 80.0 g of the methacrylic ester of a linear $C_{12}$–$C_{14}$ alcohol mixture, 304.0 g of the methacrylic acid ester of a $C_{12}$–$C_{15}$ alcohol mixture comprising 60 percent of branched alcohols;

44.8 g of methyl methcrylate, and 8.0 g of tert.-butyl peroctoate.

Polymer content: 70 percent

Viscosity (100° C., 70 weight percent): 680 mm2/sec

Composition:

15 mole percent (a)

38 mole percent (b)

47 mole percent (c), of which 25 mole percent are to be classed as linear $C_4$–$C_{15}$ alkyl methacrylates.

COMPARATIVE EXAMPLE 2

Additive D

Prepared in the same manner as Additive A, with the following exceptions:

360 g of petroleum oil ($\eta_{100°\,C.}$=3.9 mm$^2$/sec), 17.08 g of the methacrylic acid ester of a linear $C_{16}$–$C_{18}$ alcohol mixture, 22.92 g of the methacrylic acid ester of a $C_{12}$–$C_{15}$ alcohol mixture comprising 60 percent of branched alcohols, and 1.4 g of tert.-butyl peroctoate.

Addition:

341.6 g of the methacrylic acid ester of a linear $C_{16}$–$C_{18}$ alcohol mixture, 458.4 g of the methacrylic acid ester of a $C_{12}$–$C_{15}$ alcohol mixture comprising 60 percent of branched alcohols, and 8.0 g of tert.-butyl peroctoate.

Polymer content: 70 percent

Viscosity (100° C., 70 weight percent): 560 mm2/sec

Composition:

0 mole percent (a)

62 mole percent (c), of which 25 mole percent is to be classed as linear $C_4$–$C_{15}$ alkyl methacrylates.

TABLE 2

Determination of pour point in °C. in conformity with DIN 51597 NS 150 petroleum oil (viscosity, 5.4 mm$^2$/sec at 100° C.)

| | Additive | Amount of additive added (weight percent) 0.1 | 0.2 | 0.3 | 0.5 | 1.0 |
|---|---|---|---|---|---|---|
| Example 2 | C | −24 | −28 | −29 | −32 | −33 |
| Comparative Example 2 | D | −22 | −26 | −28 | −30 | −31 |

TABLE 3

Determination of pour point in C.° in conformity with DIN 51597 NS 480 Petroleum oil (viscosity 10.3 mm$^2$ at 100° C.)

| | Additive | Amount of additive added weight percent 0.1 | 0.2 | 0.3 | 0.5 | 1.0 |
|---|---|---|---|---|---|---|
| Example 2 3 | C | −21 | −23 | −26 | −28 | −29 |
| Comparative Example 3 | D | −18 | −20 | −22 | −24 | −25 |

EXAMPLE 3

Additive E

Prepared in the same manner as Additive A, with the following exceptions:

Initial charge:

300 g of petroleum oil ($\eta_{100°\,C.}$=3.9 mm2/sec), 19.31 g of the methacrylic acid ester of a $C_{12}$–$C_{15}$ alcohol mixture comprising 23 percent of branched alcohols, 10.66 g of the methacrylic acid ester of a linear $C_{16}$–$C_{18}$ alcohol mixture, 3.33 g of methyl methacrylate, 0.13 g of dodecyl mercaptan, and 0.36 g of tert.-butyl peroctoate.

Addition:

386.69 g of the methacrylic acid ester of a $C_{12}$–$C_{15}$ alcohol mixture comprising 23 percent of branched alcohols, 213.34 g of the methacrylic acid ester of a linear $C_{16}$–$C_{18}$ alcohol mixture, 66.67 g of methyl methacrylate, 2.67 g of dodecyl mercaptan, and 2.00 g of tert.-butyl peroctoate.

Polymer content: 70 percent

Viscosity (100° C., 70 weight percent): 800 mm2/sec

Composition:

24 mole percent (a)

24 mole percent (b)

52 mole percent (c), of which 40 mole percent are to be classed as unbranched $C_4$–$C_{15}$ alkyl methacrylates.

COMPARATIVE EXAMPLE 3

Additive F

Prepared in the same manner as Additive A, with the following exceptions:

Initial charge 300 g of petroleum oil ($\eta_{100°\,C.}$=3.9 mm2/sec), 24.08 g of the methacrylic acid ester of a $C_{12}$–$C_{15}$ alcohol mixture comprising 23 percent of branched alcohols, 9.22 g of the methacrylic acid ester of a linear $C_{16}$–$C_{18}$ alcohol mixture, 0.13 g of dodecyl mercaptan, and
0.36 g of tert.-butyl peroctoate.
Addition:
482.02 g of the methacrylic acid ester of a $C_{12}$–$C_{15}$ alcohol mixture comprising 23 percent of branched alcohols,
184.68 g of the methacrylic acid ester of a linear $C_{16}$–$C_{18}$ alcohol mixture,
2.67 g of dodecyl mercaptan, and
2.00 g of tert.-butyl peroctoate.
Polymer content: 70 percent
Viscosity (100° C., 70 weight percent): 560 mm2/sec
Composition:
0 mole percent (a)
24 mole percent (b)
76 mole percent (c), of which 59 mole percent are to be classed as unbranched $C_4$–$C_{15}$ alkyl methacrylates.

TABLE 4

Stable pour point in °C. in conformity with Fed. Test Method Std. No. 791 B, Method 203/Cycle C, of a 10W40 SF/CC motor oil

| | Additive | Amount of Additive in (weight percent) 0 | 0.3 |
|---|---|---|---|
| Example 3 4 | E | −10 | −36 |
| Comparative Example 4 | F | −10 | −27 |

EXAMPLE 4

Additive G

To prepare an additive, the following mixture is charged to a 2-liter four-necked flask equipped with stirrer, thermometer, reflux condenser, and metering line:
300 g of petroleum oil, ($\eta_{100°\,C.}$=3.9 mm²/sec),
20.45 g of the methacrylic acid ester of a $C_{12}$–$C_{15}$ alcohol mixture comprising 23 percent of branched alcohols,
8.75 g of the methacrylic acid ester of a linear $C_{16}$–$C_{18}$ alcohol mixture,
1.60 g of methyl methacrylate,
2.50 g of dimethylaminoethyl methacrylate:
0.13 g of dodecyl mercaptan, and
0.36 g of tert.-butyl peroctoate.
After the components have been dissolved, the following mixture is metered in over a period of 210 minutes at 100° C.:
409.4 g of the methacrylic acid ester of a $C_{12}$–$C_{15}$ alcohol mixture comprising 23 percent of branched alcohols,
175.3 g of the methacrylic acid ester of a linear $C_{16}$–$C_{18}$ alcohol, mixture,
32.0 g of methyl methacrylate,
50.0 g of dimethylaminoethyl methacrylate
2.67 g of dodecyl mercaptan, and
2.0 g of tert.-butyl peroctoate. Two hours after completion of this addition, 1.4 g of tert.-butyl peroctoate are fed in.
Total polymerization time: 8 hours. A clear, viscous solution is obtained.
Polymer content: 70 weight percent.
Viscosity (100° C., 70 weight percent): 800 mm²/sec.
Composition:
12 mole percent (a)
20 mole percent (b)
56 mole percent (c), of which
43 mole percent are classed as linear $C_4$–$C_{15}$ alkyl methacrylates,
12 mole percent (d).

EXAMPLE 5

Additive H

To prepare an additive, the following mixture is charged to a 2-liter four-necked flask equipped with stirrer, thermometer, reflux condenser, and metering line:
300 g of petroleum oil, ($\eta_{100°\,C.}$=3.9 mm²/sec),
20.32 g of the methacrylic acid ester of a $C_{12}$–$C_{15}$ alcohol mixture comprising 23 percent of branched alcohols,
8.69 g of the methacrylic acid ester of a linear $C_{16}$–$C_{18}$ alcohol mixture,
1.59 g of methyl methacrylate,
2.70 g N-dimethylaminopropyl-methacrylamide,
0.13 g of dodecyl mercaptan, and
0.36 g of tert.-butyl peroctoate.
After the components have been dissolved, the following mixture is metered in over a period of 210 minutes at 100° C.:
406.8 g of the methacrylic acid ester of a $C_{12}$–$C_{15}$ alcohol mixture comprising 23 percent of branched alcohols,
174.0 g of the methacrylic acid ester of a linear $C_{16}$–$C_{18}$ alcohol mixture,
31.8 g of methyl methacrylate,
54.1 g N-dimethylaminopropyl-methacrylamide,
2.67 g of dodecyl mercaptan, and
2.0 g of tert.-butyl peroctoate.
Two hours after completion of this addition, 1.4 g of tert.-butyl peroctoate are fed in.
Total polymerization time: 8 hours. A clear, viscous solution is obtained.
Polymer content: 70 weight percent. Viscosity (100° C., 70 weight percent): 800 mm²/sec.
Composition:
12 mole percent (a)
20 mole percent (b)
56 mole percent (c), of which
43 mole percent are classed as linear $C_4$–$C_{15}$ alkyl methacrylates
12 mole percent (d)

TABLE 5

Low-temperature viscosity (−40° C.) in mPa.s in conformity with DIN 51398 in NS 100 petroleum oil (viscosity, 3.7 mm²/sec at 100° C.)

| | Additive | Amount of additive added weight percent 0.5 | 1.0 | 1.5 |
|---|---|---|---|---|
| Example 4 | G | 118,000 | 100,000 | 114,000 |
| Example 5 | H | 71,000 | 58,000 | 89,000 |
| Comparative Example 4 | B | 126,000 | 110,000 | 156,000 |

What is claimed is:

1. A statistical copolymer, adaptable to use as a pour point lowering additive for petroleum oils, said polymer having an average molecular weight from 50,000 to 500,000 and consisting essentially of the following comonomers
(a) from 10 to 30 mole percent of methyl methacrylate, (b) from 10 to 70 mole percent of at least one alkyl methacrylate having a linear alkyl group with from 16 to 30 carbon atoms, (c) from 10 to 80 mole percent of at least one alkyl methacrylate selected from the group of alkyl methacrylates having linear alkyl groups with from 4 to 15 carbon atoms and alkyl methacrylates having branched alkyl groups with from 4 to 40 carbon atoms, and (d) from 0 to 30 mole percent of a monomer of the formula

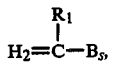

wherein $R_1$ is hydrogen or methyl and $B_s$ is

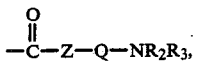

wherein Z is oxygen or $NR_4$, Q is a linear or branched hydrocarbon bridge having a total of 2 to 10 carbon atoms, $R_2$ and $R_3$ are alkyl having from 1 to 6 carbon atoms, and $R_4$ is hydrogen or alkyl having from 1 to 6 carbon atoms.

2. A copolymer as in claim 1 wherein monomer component (a) is from 10 to 20 mole percent of said polymer.

3. A petroleum oil comprising from 0.1 to 1.0 percent by weight of a copolymer as in claim 2 as a pour point lowering additive.

4. A copolymer as in claim 1 wherein monomer component (b) is from 10 to 50 mole percent of said polymer.

5. A petroleum oil comprising from 0.1 to 1.0 percent by weight of a copolymer as in claim 4 as a pour point lowering additive.

6. A copolymer as in claim 1 wherein monomer component (c) is from 80 to 30 mole percent of said polymer.

7. A petroleum oil comprising from 0.1 to 1.0 percent by weight of a copolymer as in claim 6 as a pour point lowering additive.

8. A copolymer as in claim 1 wherein monomer component (d) is from 20 to 0.5 mole percent of said polymer.

9. A petroleum oil comprising from 0.1 to 1.0 percent by weight of a copolymer as in claim 8 as a pour point lowering additive.

10. A petroleum oil comprising from 0.1 to 1.0 percent by weight of a copolymer as in claim 1 as a pour point lowering additive.

11. A statistical copolymer, adaptable to use as a pour point lowering additive for petroleum oils, said polymer having an average molecular weight from 50,000 to 500,000 and consisting essentially of the following comonomers (a) from 10 to 30 mole percent of methyl methacrylate, (b) from 10 to 70 mole percent of at least one alkyl methacrylate having a linear alkyl group with from 16 to 30 carbon atoms, and (c) from 10 to 80 mole percent of at least one alkyl methacrylate selected from the group of alkyl methacrylates having linear alkyl groups with from 4 to 15 carbon atoms and alkyl methacrylates having branched alkyl groups with from 4 to 40 carbon atoms.

* * * * *